US010457305B2

(12) United States Patent
Braband

(10) Patent No.: US 10,457,305 B2
(45) Date of Patent: Oct. 29, 2019

(54) TRACKSIDE RAILWAY APPARATUS AND METHOD FOR DETECTING USE OF AT LEAST ONE TRACKSIDE COMPONENT OF A RAILWAY INSTALLATION

(71) Applicant: SIEMENS AKTIENGESELLSCHAFT, Munich (DE)

(72) Inventor: Jens Braband, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 82 days.

(21) Appl. No.: 15/743,499

(22) PCT Filed: Jun. 14, 2016

(86) PCT No.: PCT/EP2016/063592

§ 371 (c)(1),
(2) Date: Jan. 10, 2018

(87) PCT Pub. No.: WO2017/008978

PCT Pub. Date: Jan. 19, 2017

(65) Prior Publication Data

US 2018/0201287 A1 Jul. 19, 2018

(30) Foreign Application Priority Data

Jul. 10, 2015 (DE) ..... 10 2015 212 958

(51) Int. Cl.

| | |
|---|---|
| ***B61L 27/00*** | (2006.01) |
| *B61L 3/12* | (2006.01) |
| *B61L 25/02* | (2006.01) |

(52) U.S. Cl.

CPC ..... *B61L 27/0088* (2013.01); *B61L 3/121* (2013.01); *B61L 3/125* (2013.01); *B61L 25/025* (2013.01)

(58) Field of Classification Search

CPC ..... B61L 27/0088

See application file for complete search history.

(56) References Cited

U.S. PATENT DOCUMENTS 8,786,426 B2 * 7/2014 Rosetti ..... B61L 27/0088 246/217

2014/0111321 A1 4/2014 Fox (Continued)

FOREIGN PATENT DOCUMENTS

DE 102004031332 A1 2/2006
DE 102007035916 A1 2/2009

(Continued)

OTHER PUBLICATIONS

Körkemeier H et al: "Weichendiagnose Switchguard Sidis W compact" [Switch Diagnosis Switchguard Sidis W Compact]; Signal+ Draht, DVV; vol. 103, No. 4; pp. 6-10; XP001560516, ISSN: 0037-4997; 2011—English abstract.

(Continued)

*Primary Examiner* — Clayton E. LaBalle
*Assistant Examiner* — Jas A Sanghera
(74) *Attorney, Agent, or Firm* — Laurence Greenberg; Werner Stemer; Ralph Locher

(57) ABSTRACT

A trackside railway apparatus includes at least one sensor device which is configured to detect at least one use of at least one trackside component of a railway installation. A storage device stores at least one item of use information dating or tracing back to the detection of the use. A transmission device is configured to wirelessly transmit the usage information to at least one receiving device entering a transmission range in a manner which is temporally decoupled from the storage. The apparatus is configured to detect the at least one receiving device entering the transmission range. A device for determining use of at least one trackside component of a railway system and a method for detecting use of at least one trackside component of a railway installation are also provided.

15 Claims, 1 Drawing Sheet

(56) References Cited

U.S. PATENT DOCUMENTS

| | | | |
|---|---|---|---|
| 2014/0277824 | A1 | 9/2014 | Kernwein et al. |
| 2015/0158511 | A1 | 6/2015 | Fries et al. |

FOREIGN PATENT DOCUMENTS

| | | | |
|---|---|---|---|
| DE | 102009009449 | A1 | 8/2010 |
| DE | 102009024506 | A1 | 12/2010 |
| EP | 0957020 | A1 | 11/1999 |
| EP | 2236389 | A2 | 10/2010 |
| EP | 2873585 | A1 | 5/2015 |
| WO | 2009042283 | A2 | 4/2009 |
| WO | 2012101152 | A1 | 8/2012 |

OTHER PUBLICATIONS

Infratec GMBH: "VarioCAM hr Research—Mobile Thermografiekamera für Forschung und Entwicklung" [Mobile Thermographic Camera for Research and Development]; Infrarotsensorik und Messtechnik; Dresden; 2013—English abstract.

Drewello et al: "Kapazitätsbelastung der Rheintalbahn; Zugzahlmessung mit Infrarottechnik" [Capacity Load of The Rhine Valley Train—Train Frequency Measurement by Means of Infrared Technology]; Internationales Verkehrswesen; vol. 65, No. 4; 2013; pp. 48-51 English abstract.

* cited by examiner

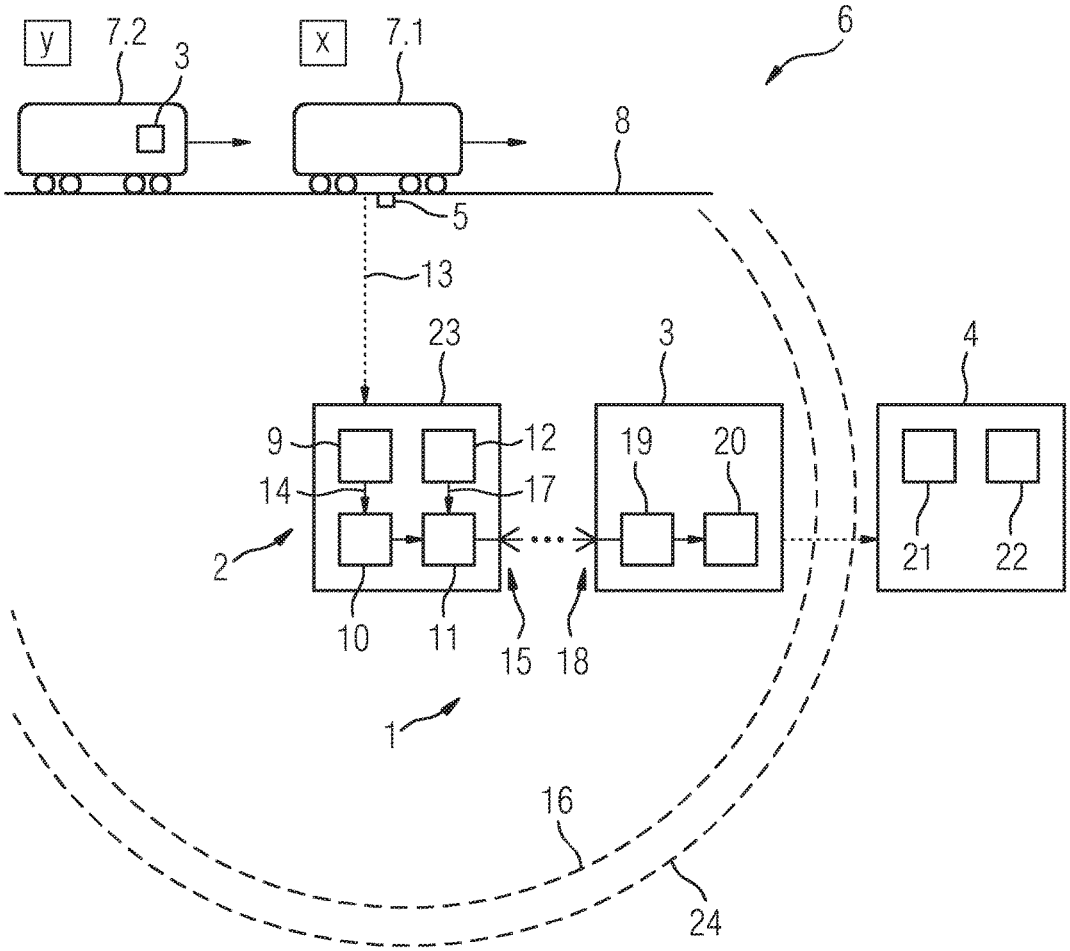
y
7.2
3
x
7.1
6
8
5
13
23
3
4
9
12
19
20
14
17
2
21
22
10
11
15
18
1
16
24

TRACKSIDE RAILWAY APPARATUS AND METHOD FOR DETECTING USE OF AT LEAST ONE TRACKSIDE COMPONENT OF A RAILWAY INSTALLATION

BACKGROUND OF THE INVENTION

Field of the Invention

In the outdoor area of a railway system, components such as axle counters, DC circuits, switch machines, track sections and similar are used. These outdoor components operate in surroundings that are exposed to numerous disturbing influences and environmental effects. It is mandatory that the functionality of such components be fully tested in a demonstrable manner during a failure disclosure time, e.g. once a day or once a year, depending on the frequency of use and type of component. This functional testing can be performed, for example, by a rail vehicle traversing the section of track. This traversing of the section of track and the associated use must where possible be verified at a later time, e.g. during an inspection. Particularly in the case of rarely used tracks, so-called rusty-rail tracks, such verification can be difficult because, for example, there is no timetabled use of these sections of track. In order to nevertheless have a record of use, such tracks are sometimes traversed by a rail vehicle specifically to obtain verification of use. The fact that a section of track has already been used previously is often not demonstrable because, for example, other rail companies have used it or there are no records of it having been used. Such uses specifically initiated to verify use are costly and time-consuming.

SUMMARY OF THE INVENTION

The object of the present invention is therefore to provide an apparatus and a method of the type mentioned in the introduction which provide a simple and inexpensive means of verifying use of a trackside component of a railway system.

This object is achieved according to the invention by a trackside railway apparatus having at least one sensor device designed to detect at least one use of at least one trackside component of a railway system, having a storage device for storing at least one item of use information dating from the detection of use, and having a transmission device designed to wirelessly transmit the use information, independently of the time of storage thereof, to at least one receiving device entering a transmission range, wherein the apparatus is designed to detect when the at least one receiving device enters a detection range.

Said object is also achieved by a method for detecting use of at least one trackside component of a railway system, wherein use of the component is detected, at least one item of use information dating from the detection is stored, entry of at least one receiving device to a detection range is identified, and the use information is transmitted wirelessly to the at least one receiving device independently of the time of storage thereof.

The advantage of the solution according to the invention is that use of the trackside component is detected in a simple manner, stored in an item of use information and this use information is transferred for further processing. Finally, the use information can then be further processed centrally in order to centrally document and provide evidence of use of different trackside components.

According to the invention, the use information is first stored in the storage device so that each use is recorded. As soon as a receiving device possibly happens to enter the detection range, the use information is communicated thereto. Said detection range is greater than, equal to or smaller than the transmission range. The receiving device is therefore used as a means of transmitting the stored use information. The receiving device can be located, for example, on board a rail vehicle or be any mobile telephone entering the transmission range randomly or in a scheduled manner. Thus, the apparatus according to the invention can be of very simple and inexpensive design, as the use information only needs to be transmitted in the local transmission range.

Detection of use is possible using different technologies, e.g. by infrasound or vibration sensors as well as by a camera or ammeter which detects, for example, the operation of a switch motor or axle counter.

In the prior art, a remote monitoring device is known from WO 2009/042283 A2 or a wheel sensor with wireless signal transmission from DE 10 2009 009 449, but these devices are not used for detecting use.

The solution according to the invention can be further developed by advantageous embodiments which are described in the following.

Thus, the apparatus can have at least one detection device designed to detect when the at least one receiving device enters a detection range. The advantage of this is that the detection device is part of the apparatus according to the invention, thereby obviating the need for the apparatus to have complex/costly interfaces to the outside. The detection device can in particular comprise at least one infrasound, vibration and/or magnetic field sensor. These are sensors that are suitable, for example, for detecting an approaching train.

In order to be able to transmit the use information to as many receiving devices within transmission range as possible, the transmission device can be designed to transmit the use information as a broadcast signal.

In addition, the transmission device can be designed to transmit the use information by means of a wireless local area network, in particular a WLAN. The advantage of this is that such networks can be created inexpensively, thereby keeping down the costs of the apparatus according to the invention. The transmission device can also be designed to transmit the use information in an essentially fixed frequency band, in particular of around 5.9 GHz. This frequency is particularly suitable for transmitting the use information, as it is reserved for data transmission of this kind and is unlikely to be affected by other transmitters.

In order to be able to evaluate the use information for verification of use, the use information can comprise at least one time of use and/or type of use. Time of use would be here the point in time at which the sensor device has detected the use. Type of use is, for example, an identifier or coding of the sensor device to indicate which component has operated or rather which sensor has picked up what signal. For example, it can be interpreted from the type of use that a train has passed by, a switch motor has operated or an axle counter has detected an axle.

In order to simplify the design of the apparatus as much as possible and make it independent of an external energy supply, the apparatus can have at least one energy storage device and/or an energy harvesting device as an autonomous energy supply. Energy harvesting is to be understood here as meaning, for example, the use of energies available in nature, such as solar energy, wind energy or similar. With this further development, the apparatus can operate in an energy-autonomous manner for many years and also be disposed, for example, in a protected manner, e.g. underground or on a pole, remotely from a power supply line.

In an advantageous embodiment, the storage device can be designed to delete the at least one item of use information in a time- and/or volume-controlled manner. The advantage of this is that sufficient storage space is always available in the storage device and it is unnecessary replace the storage medium.

The invention also relates to a device for determining use of at least one trackside component of a railway system, having at least one inventive apparatus according to one of the above mentioned embodiments, having at least one receiving device to which the apparatus communicates the use information and which is designed to forward the communicated use information, and having a evaluation device to which the receiving device forwards the use information and which evaluates the communicated use information to transmit the use. By means of the device according to the invention, use of the component can be easily verified.

In an advantageous embodiment, the receiving device can be connected to a vehicle, in particular a rail vehicle. The advantage of this is that the use information is transmitted to the receiving device located in the vehicle and is conveyed with the vehicle. The vehicle can, for example, forward the use information to the evaluation device at a later time, e.g. in the rail depot. Thus, for example, the use information does not require a cellular or radio network.

In addition, the receiving device can be implemented as a mobile device, in particular a mobile telephone, tablet or handheld device. Thus so-called crowd sourcing can be used to transmit the use information to the evaluation device. For example, any persons who, for example, have installed a special app on their mobile telephone, can be used for data collection of the use information. It would be conceivable, for example, for these persons to be offered an incentive for forwarding the use information, e.g. reward points or a small sum of money in order to reward them for forwarding the use information.

In an advantageous embodiment of the method according to the invention, the use information being transmitted can be forwarded, in particular by means of crowd sourcing, and evaluated to determine use. As already described above, the advantage of this is that the evaluated use information can be stored as verification of use. Thus, verification of use is also easily possible retrospectively for each component so that, for example, maintenance intervals can be adjusted. In order to check maintenance intervals, the determined use can also be compared with scheduled use of the component. This indicates whether a current maintenance interval or a current maintenance schedule is still appropriate or whether the maintenance interval needs to be changed.

BRIEF DESCRIPTION OF THE SEVERAL VIEWS OF THE DRAWING

The invention will now be explained with reference to the exemplary embodiment of the invention as shown in the accompanying drawing.

The FIGURE schematically illustrates an exemplary embodiment of a device according to the invention for determining use of at least one trackside component of a railway system.

DESCRIPTION OF THE INVENTION

In the FIGURE, an exemplary embodiment of an inventive device 1 for determining use is illustrated in schematic form. The device 1 comprises an inventive trackside railway apparatus 2, a receiving device 3 and an evaluation device 4. The device 1 is designed to determine use of at least one component 5 of a railway system 6. The railway system 6 has, for example, rail vehicles 7.1, 7.2 which travel along a track 8. The railway system 6 also comprises, in addition to the rail vehicles 7.1, 7.2 and the track 8, the at least one trackside component 5 which can be, for example, a switch motor or even a track section of the track 8.

In the exemplary embodiment in the FIGURE, the railway apparatus 2 disposed trackside has a sensor device 9, a storage device 10, a transmission device 11, and a detection device 12. The apparatus 2 also has a separate housing 23 in which said devices are disposed.

The sensor device 9 is designed to detect use of the component 5. In the exemplary embodiment in the FIGURE, the component 5 is a track section of the track 8, the traversing of which by the rail vehicle 7.1, 7.2 is to be verified and recorded as use thereof. For this purpose the sensor device 9 comprises, for example, an infrasound sensor (not shown) which detects the passing rail vehicle 7.1, 7.2. The use of the component 5, here by the rail vehicle 7.1, 7.2, produces a signal 13 which reaches the sensor device 9. The signal 13 is here, for example, an infrasound signal. Alternatively, this signal 13 can also be, for example, a vibration signal, a light signal or image signal which can be captured by a camera, for example, or a pressure signal. The sensor device 9 detects the signal 13 and converts it into characteristic quantity, e.g. an analog current signal. The sensor device 9 also determines the time at which the signal 13 was detected. From the time of use and the characteristic quantity, the sensor device 9 in the exemplary embodiment in the FIGURE creates use information 14 which it transmits to the storage device 10. The use information 14 can also include other data.

The storage device 10 comprises, for example, a data storage medium on which the use information 14 is stored. A large number of items of use information 14 can be stored in the storage device 10. These can all relate to the same component 5, but also to a plurality of components 5. In the exemplary embodiment, the storage device is designed for time-controlled deletion of the use information, i.e. items of use information are automatically deleted when a predefined storage time is exceeded. Alternatively, the storage device 10 can also be designed, for example, for volume-controlled deletion of the use information. Here items of use information are deleted when a particular storage volume of the storage device 10 is reached. The storage device 10 has a signaling link to the transmission device 11 so that the use information 14 can be transmitted from the storage device 10 to the transmission device 11.

The transmission device 11 is designed for wireless data transmission and, in the exemplary embodiment in the FIGURE, has an antenna 15 for this purpose. The transmission device 11 can transmit the use information 14 stored in the storage device 10 within a transmission range 16. The transmission range 16 is designed relatively small, e.g. in a radius of about 50 to 100 m around the transmission device 11. Due to this short transmission range, the transmission device 11 advantageously requires relatively little energy. For power supply purposes, the apparatus 2 has an energy storage device (not shown). Alternatively, power can be supplied by an energy harvesting device which utilizes natural energy sources such as solar or wind power, for example, to generate and supply energy for the apparatus 2. In the exemplary embodiment shown in the FIGURE, the transmission device 11 comprises a WLAN router so that the use information 14 is transmitted in the WLAN produced which operates at a fixed frequency of 5.9 GHz.

The detection device 12 is designed to detect a receiving device 3 entering the transmission range 16. For this purpose the detection device 12 has an infrasound, vibration or magnetic field sensor, for example, with which an approaching rail vehicle 7.1, 7.2 can be detected within a detection range 24. The detection range 24 is advantageously larger than the transmission range 16. Alternatively, the detection device 12 can also have a suitable sensor which detects a mobile telephone entering the detection range 24 and to which the use information 14 can be transmitted. As soon as the detection device 12 has detected a receiving device 3, it applies an activation signal 17 to the transmission device 11 to begin transmitting the use information 14. The use information items are transmitted by the transmission device 11 as a broadcast signal. The broadcast signal is advantageous in that it is transmitted to all the participants of the local area network within the transmission range 16 without these participants having to be explicitly specified as receivers. This makes transmission particularly simple.

The receiving device 3 is designed to receive the use information 14 transmitted by the apparatus 2 and, in the embodiment shown in the FIGURE, has an antenna 18 for receiving said use information 14. In addition to the antenna 18, in the exemplary embodiment in the FIGURE the receiving device 3 also has a receiving module 19 and a transmitting module 20. The receiving device 3 receives the use information 14 using the receiving module 19. The use information 14 is forwarded from the receiving module 19 to the transmitting module 20 which is designed to transmit the use information 14 to the evaluation device 4. The transmitting module 20 can be, for example, the transmitter of a mobile telephone or also a transmitting apparatus in a depot of the railway system, for example, which transmits the use information 14 to a cable-based network.

In the exemplary embodiment shown in the FIGURE, the evaluation device 4 comprises a computing device 21 and a memory 22. In the computing device 21, the use information 14 is evaluated and the use of the components 5 is determined therefrom. Thus, for example, it is determined that the component 5 was traversed by a vehicle 7.1, 7.2 at a particular point in time. This use is stored in the memory 22, thereby constituting a verification of use. This verification of use can be read out again at some later time, e.g. when it is to be demonstrated that the section of track 8 has been used within a particular period.

The stored uses can also be used, for example, to adjust maintenance schedules for the track 8 and/or the component 5. The determined use stored in the memory 22 is compared with a scheduled use of the component 5 or the track 8. If more frequent use than scheduled is present, a maintenance interval possibly needs to be reduced. If use is less frequent, the maintenance interval can possibly be increased. If no use is transmitted for a long period of time, this can be evaluated as a defect, for example, and appropriate action taken.

The device 1 according to the invention in the exemplary embodiment in the FIGURE can be used to detect use of the trackside component 5 of the railway system 6 as described below.

The component 5 is used at a time of use X by being traversed by the rail vehicle 7.1. This causes a signal 13 to be generated which is detected by the sensor device 9 of the apparatus 2. Use information 14 determined therefrom is stored in the apparatus 2 by the storage device 10. The use information 14 remains stored in the storage device 10 until such time as a receiving device 3 enters the transmission range 16 and receives the use information 14. As the transmission device 11 of the apparatus 2 is only designed to transmit the use information 14 over a relatively short distance within the transmission range 16, forwarding of the use information 14 by means of the receiving device 3 is necessary in order to transmit the se use information 14 to the evaluation device 4.

The receiving device 3 is located, for example, on board another rail vehicle 7.2 which enters the transmission range 16 at a later time Y with respect to the time of use X. The detection device 12 detects the approaching rail vehicle 7.2 in the detection range 24 and applies the activation signal 17 to the transmission device 11. The use information 14 is then sent out by the transmission device 11 and transmitted to the receiving device 3. The receiving device 3 is designed to communicate the use information 14 to the evaluation device 4.

The use information 14 transmitted to the evaluation device 4 is evaluated in the evaluation device 4 and the determined use of the component 5 is stored in the memory 22. For transmitting the use information 14, the invention advantageously uses any suitable receiving device 3 entering the transmission range 16 randomly or on a scheduled basis. This type of transmission can also be termed crowd sourcing. As a result, the apparatus 2 according to the invention is implemented using a very simple transmitter, thereby making it particularly inexpensive and low-maintenance.

The apparatus 2 according to the invention is usually implemented separately from the components 5, e.g. axle counters, i.e. in the separate housing 23. The advantage of this is that existing approvals of the components 5 do not need to be renewed and the apparatus 2 can be easily retrofitted. The apparatus 2 can be disposed and designed such that, for example, the uses of a plurality of components 5 can also be jointly detected and forwarded by an apparatus 2.

The invention claimed is:

1. A trackside railway apparatus, comprising:

at least one sensor device configured to detect at least one use of at least one trackside component of a railway system;

a storage device for storing at least one item of use information dating from the detection of use;

a transmission device configured to wirelessly transmit the use information, independently of a time of storage of the use information, to at least one receiving device entering a transmission range; and the apparatus being configured to detect the at least one receiving device entering a detection range.

2. The apparatus according to claim 1, which further comprises at least one detection device configured to detect the at least one receiving device entering the detection range.

3. The apparatus according to claim 2, wherein said detection device is configured to apply an activation signal to said transmission device as soon as said detection device has detected the at least one receiving device in order to initiate transmission of the use information.

4. The apparatus according to claim 2, wherein said detection device includes at least one of at least one infrasound, vibration or magnetic field sensor.

5. The apparatus according to claim 1, wherein said transmission device is configured to transmit the use information as a broadcast signal.

6. The apparatus according to claim 1, wherein said transmission device is configured to transmit the use information over a wireless local area network or a WLAN.

7. The apparatus according to claim 6, wherein said transmission device is configured to transmit the use information using a substantially fixed frequency band or using a frequency band of approximately 5.9 GHz.

8. The apparatus according to claim 1, wherein the use information includes at least one of at least one time of use or type of use.

9. The apparatus according to claim 1, which further comprises at least one of at least one energy storage device or energy harvesting device for autonomous energy supply.

10. The apparatus according to claim 1, wherein said storage device is configured to delete the at least one item of use information in at least one of a time-controlled or volume-controlled manner.

11. A device for determining use of at least one trackside component of a railway system, the device comprising:

at least one apparatus according to claim 1;

at least one receiving device to which said apparatus transmits the use information, said at least one receiving device being configured to forward the transmitted use information; and an evaluation device to which said at least one receiving device forwards the use information, said evaluation device evaluating the use information to determine the use.

12. The device according to claim 11, wherein said at least one receiving device is connected to a non-rail vehicle or a rail vehicle.

13. The device according to claim 11, wherein said at least one receiving device is a mobile device, a mobile telephone, a tablet or a handheld device.

14. A method for determining use of at least one trackside component of a railway system, the method comprising the following steps:

detecting use of the component;

storing at least one item of use information dating from the detection of use;

detecting entry of at least one receiving device into a detection range; and wirelessly transmitting the use information to the at least one receiving device independently of a time of storage of the use information.

15. The method according to claim 14, which further comprises initiating transmission of the use information as soon as the at least one receiving device is detected entering the detection range.

* * * * *